United States Patent [19]

Riechert

[11] 4,201,545

[45] May 6, 1980

[54] GRATE WITH REPLACEABLE WEAR ELEMENTS

[76] Inventor: Dieter Riechert, Lohhorn 5, Hamburg 54, Fed. Rep. of Germany, 2000

[21] Appl. No.: 911,486

[22] Filed: Jun. 1, 1978

Related U.S. Application Data

[63] Continuation-in-part of Ser. No. 887,823, Mar. 17, 1978, abandoned.

[30] Foreign Application Priority Data

Mar. 31, 1977 [DE] Fed. Rep. of Germany ... 7710129[U]
Oct. 21, 1977 [DE] Fed. Rep. of Germany ... 7732560[U]

[51] Int. Cl.[2] ..... F27D 1/12; F26B 9/00

[52] U.S. Cl. ..... 432/239; 34/164; 110/328

[58] Field of Search ..... 432/239; 34/164, 237; 110/328

[56] References Cited

U.S. PATENT DOCUMENTS

| | | | |
|---|---|---|---|
| 3,624,920 | 12/1971 | Coutelan | 34/164 |
| 3,638,928 | 2/1972 | Mitchell | 432/239 |
| 3,961,588 | 6/1976 | Bode et al. | 34/164 |
| 4,078,883 | 3/1978 | Arnold | 432/239 |

*Primary Examiner*—John J. Camby

[57] ABSTRACT

Grate for cooling or combustion heating of granular materials, fixed or longitudinally reciprocable, comprising a one-piece frame-like base plate and rod-like wear elements individually detachably secured to and over the forward area of the plate to define a material support surface. Attachment of the elements is by means of interengaging, transversely extending, longitudinally spaced guide means integral with the plate and elements. A central recess in the plate enables insertion one by one from above or from below, of the elements, whereupon each may be translated laterally along the guide means into emplaced position leaving only a central space filled by an element distinguished by a rearwardly projecting finger. Means are provided to engage the finger to releasably hold the central wear element in emplaced position. The wear elements conjointly form apertures which, together with those in the plate, enable passage of air through the grate.

9 Claims, 5 Drawing Figures

FIG. 1
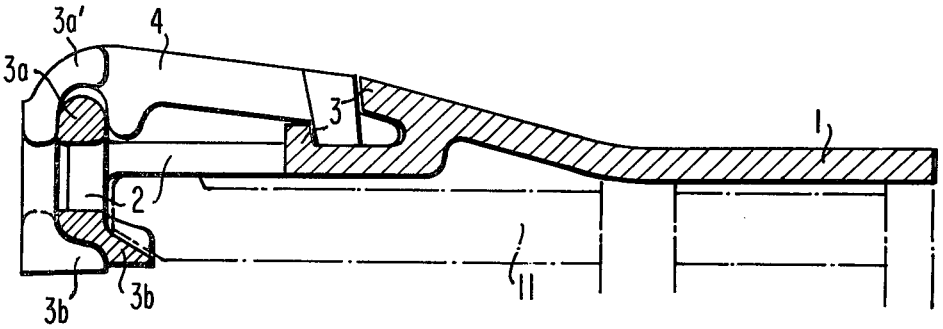
FIG. 2
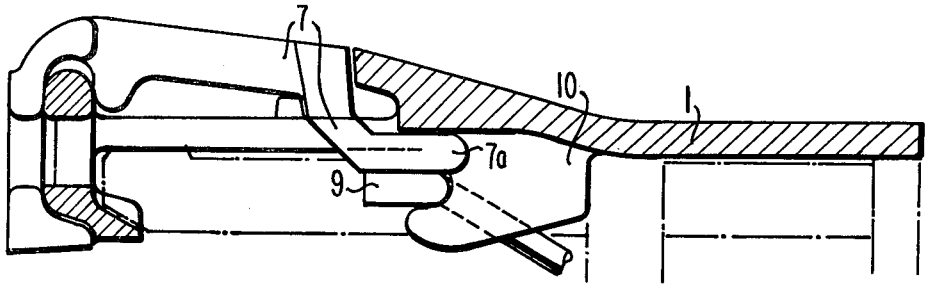
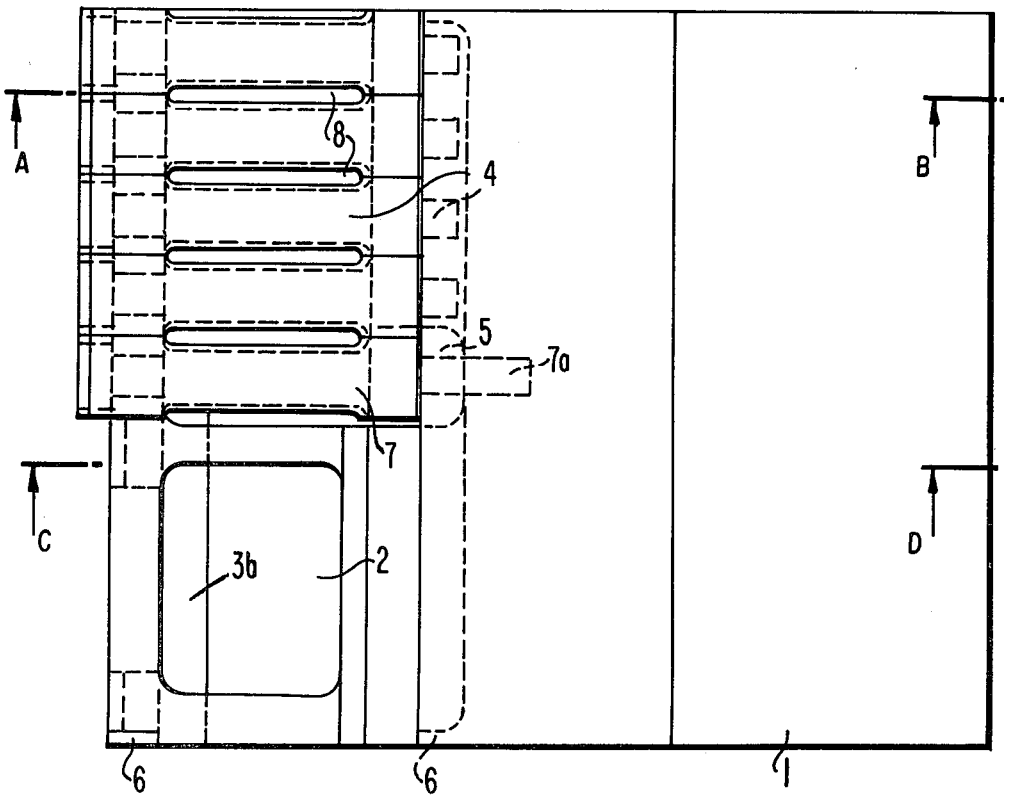
FIG. 3

GRATE WITH REPLACEABLE WEAR ELEMENTSCROSS-REFERENCE TO RELATED APPLICATION

This is a C-I-P of a copending application Ser. No. 887,823 filed Mar. 17, 1978, now abandoned, under the priorities of German applications Nos. G 77 10 129.2 filed Mar 31, 1977 and G 77 32 560.1 filed Oct. 21, 1977 and the filing date of the above U.S. application and the priorities under the Convention of the German applications are claimed herefor.

Application Ser. No. 701,245, filed June 30, 1976, U.S. Pat. No. 4,078,883, Mar. 14, 1978, entitled to a convention date in Germany, of July 4, 1975, application No. G 75 21 218.9 is made of record.

BACKGROUND OF THE INVENTION

The aforementioned application discloses a grate comprising a one-piece frame-like base plate supporting a plurality of replaceable rod-like wear elements. At its forward area the plate is provided with integral, transversely extending, longitudinally spaced recesses and projections or guides. The wear elements are formed with integral complementary guides interfitting with those of the plate so that each may, in turn, be slid into emplaced position from one side edge of the plate. In such positions each element is held against upward and downward displacement with respect to the plate. When all elements are emplaced in side-by-side contact they fill the extent of the guide means. The two elements at the respective ends of the row thus formed are held against lateral displacement by contact with side walls of the stoker or plate support. Thus, all wear elements are integrally associated with the grate plate and their upper surfaces conjointly form a smooth materials-supporting surface.

The aforesaid construction has certain disadvantages because of difficulty in the replacement of individual wear elements. Further, since the end elements are in contact with side walls of the support, they are subject to wear in the case of reciprocating plates and may become loose and displaced. This may result in increased rate of wear of all the elements; and when excessive wear occurs the spaces formed by and between contiguous elements may be increased to an undesirable extent and thus permit an undesirable increase in riddlings and detritus.

SUMMARY OF THE INVENTION

The aforesaid problems are solved by the present invention, by a construction wherein replacement of wear elements is greatly facilitated, by making them insertable and removable from the top or from the bottom of the grate plate. While the interengaging, laterally extending guide means in the form of projections and channels are in general retained as previously described, there is also provided a central or middle recess in the plate through which each element is, in turn inserted then translated right or left as the case may be, until a continuous side-by-side row of wear elements has been assembled except for one in the center. The middle or central element is then emplaced to complete the assembly. The central element is provided with an integral, rearwardly extending pin or finger which in the emplaced position extends beneath the base plate where it is engaged and firmly held against vertical displacement with respect to the plate. The plate has apertures in its top and front surfaces enabling passage of cooling or combustion air. It is also provided with fixed or integral abutments at each side and which in the completed assembly engage the right and left outermost ones of the wear elements and positively locate them in correct positions with adequate clearance from the side walls of the support. As in the application identified, the wear elements are centrally constricted in their transverse dimensions so that each contiguous pair forms a slot or opening for passage of air.

By the construction described, replacement of wear elements is greatly facilitated because it is merely necessary to first remove the T-bolt securing the finger of the middle element, whereafter it may be removed. Then the remaining elements may be sequentially removed for repair or replacement.

The aforsaid construction is not readily available where the traction element engages or is secured to the grate by key means. With such constructions the problem is solved by so constructing and arranging the extended pin or finger of the middle wear element that it engages and is held by the grate support, against vertical displacement. Thus, when it is required to install, renew or replace wear elements, the relatively heavy base plate need not be extended but merely displaced a short distance in the direction of conveyance or translation of the grate, until the end of the extended pin of the middle wear element moves free of the grate support. In its displaced position the middle element and subsequently the laterally emplaced elements may be removed and replaced, upwardly or downwardly, by shifting them in succession, laterally to the position formerly occupied by the middle element.

BRIEF DESCRIPTION OF THE DRAWING

FIG. 1 is a longitudinal vertical section taken in a plane identified by line A–B, Fig. 3, and showing one form of the invention;

FIG. 2 is a sectional view corresponding to FIG. 1, taken in a plane identified by line C–D, Fig. 3;

FIG. 3 is a plan view of the species of FIGS. 1 and 2 with some of the wear elements omitted, for clarity of illustration;

DESCRIPTION OF THE PREFERRED EMBODIMENTS

Figure 4:
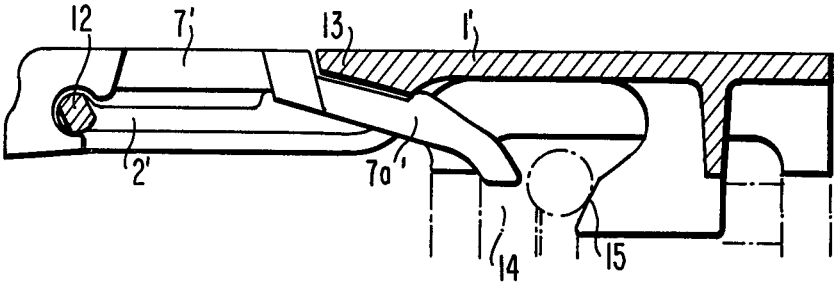
FIG. 4 is a vertical longitudinal section in a plane identified by line E–F, FIG. 5, showing a second species of the invention.

Referring to FIGS. 1 to 3, a base plate 1 which may be inclined upwardly and forwardly, is provided with openings 2 at its forward area for passage of cooling or combustion air. The plate is formed to afford transversely-extending projections and channels or recesses defining guideways 3*a* and 3*b* to accomodate a plurality of wear elements 4. As is clear from inspection of FIG. 1, these elements are formed with guideways 3*a*′ and 3*b*′ shaped complementarily to those of the plate, so that they may be inserted in sequence through middle or central recess 5, FIG. 2, and then translated laterally of the plate to emplaced positions as shown at FIG. 3. Abutments 6, FIG. 3, are integral with plate 1 and are located at each side thereof. These engage the outermost ones of the elements at each side edge of the plate, and limit or prevent further lateral dislacement thereof.

When the correct number of wear elements have been thus successively inserted, first through middle recess 5 and then guidedly translated by and along projections or guides 3, right or left, each into contact with the element next previously inserted, there remains a centrally-located space into which a central or middle wear element 7 may fit. As shown upon FIG. 2, element 7, while of the same general shape and dimensions as the others, is provided additionally with an integral finger or pin *7a* and which in the emplaced position projects rearwardly beneath and contacts the contiguous lower surface of plate 1. In this position the wear elements 4 and 7 conjointly define a smooth upper surface. As seen upon FIG. 3, the elements are decreased between their ends, in the lateral directions, to define a plurality of openings 8, for passage of air. By the T-bolt 9 on hook 10 the base plate and middle element 7 are held on the grate support. The so-called grate support finger 11 which belongs to the plate fastening, is indicated in dotted lines.

Figure 5:
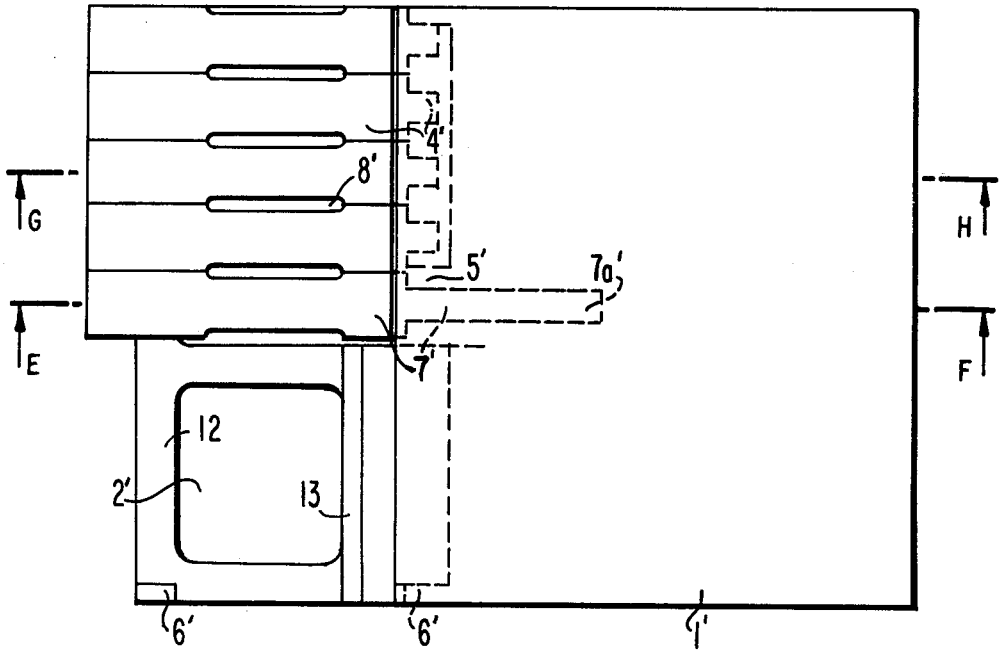
FIG. 5 is a plan view of the form depicted upon FIG. 4, with some of the wear elements omitted as in FIG. 3.

As shown upon FIGS. 4 and 5, base plate 1' is, as in the species of FIGS. 1 to 3, provided with openings 2' for passage of air, and recesses or guidways 3' extending transversely. Wear elements 4 ' are shaped to complementally fit the recesses and guideways to that when inserted from above or below, through central or middle recess 5', they may be sequentially translated laterally into side-by-side contact or abutment with those previously emplaced. The correct location of the two outermost elements 4', right and left, is determined by abutments 6', integral with plate 1'.

Thus, as in the species of FIGS. 1 to 3, when the correct and predetermined number of wear elements have been emplaced, right and left, there remains a central space into which fits the central or middle element 7'. While essentially like those indicated at 4', this element has in addition a rearwardly-extended finger or projection *7a'* and which when emplaced as shown upon FIG. 4, has its distal end resting loosely on the top side of grate support 14. The fastening device of the grate is identified at 15, FIG. 4. Slots or openings 8' for passage of air are indicated as formed by and between contiguous elements.

The grates shown on FIGS. 1 to 3 may be fixedly mounted. They can however also be mounted to move back and forth. The same applies for the grates shown upon FIGS. 4 and 5. Both grates are employable for use in stokers.

The finger *7a*, FIG. 2, is the central grate member. This central grate member is mounted on the grate by means of "T" bolt 9. This finger represents an extension of the grate holder and therefore does not need to be separately secured. Finger *7a'*FIG. 4, is the central grate member and it lies on the carrier 14 without any additional mounting. In this embodiment this carrier does not need any support finger.

Should the mounting of the grate plate on the grate carrier be of further interest, this is shown on FIG. 4 only in a cutoff view. The additional information thereon, however, is evident from U.S. Pat. No. 3,961,588. From the cross section of the drawings in the right hand half the wedge mounting is evident.

I claim:

1. A grate for cooling or combustion of granular materials, comprising:

a grate support;

a one-piece base plate carried by said support in generally a horizontal position and having a forward edge area and a rearward edge area with an air passage opening through the forward edge area;

said opening being bounded along its forward and rearward edges by longitudinally spaced, transversely extending, parallel guideways integral with said plate, there being a recess in said rear guideway, centrally thereof;

a plurality of elongate rod-like first wear elements each having forward and rearward ends and opposite side edges, the forward and rearward ends each formed with guideways complementally fitting the guideways of said plate, for guided transverse translation thereby;

each said first element being insertable through said central recess, then translatable laterally, right and left, on and along the guideways of said plate, and said guideways restraining said wear elements against upward or downward displacement relative to said base plate;

a second elongate rod-like wear element having forward and rearward ends and opposite side edges, said second wear element insertable throught said central recess and into the space remaining after said first elements have been emplaced, said second wear element having a finger fixed therewith and projecting in the emplaced position, rearwardly below the lower surface of said plate; and means below the base plate releaseably engaging the distal end of said finger to hold the second element against vertical displacement relatively to said base plate.

2. The grate of claim 1, said first and second wear elements extending in contacting side-by-side relation throughout the transverse dimension of said plate, to conjointly form a materials support surface.

3. The grate of claim 2, said first and second wear elements having recesses at their side edges defining openings so that each contiguous pair forms an air passage between them.

4. The grate of claim 2, abutment means fixed with said plate at each side edge thereof, adjacent said forward area, the outermost ones of said first elements, right and left, engaging said abutment means at its respective side, to thereby limit laterally outward translation thereof.

5. The grate of claim 4, the lateral separation of said abutment means at the two sides of the plate, being equal to the total combined width of said first and second elements.

6. The grate of claim 1, said last-named means comprising a detachable T-bolt having a head detachably holding said finger to said base plate.

7. The grate of claim 1, said last-named means comprising an upwardly-facing generally horizontal surface of said grate support.

8. The grate of claim 1, said base plate and wear elements being translatable as a unit in parallel with the longitudinal dimension of said plate, between first and second positions, said last-named means comprising a substantially horizontal surface of said grate support, and engaged by the distal end of said finger only when said plate is in first position, said finger being free of said surface in second position to thereby enable vertical displacement of said second wear element and free the same from said plate.

9. The grate of claim 6, wherein the finger extends beneath and in engagement with a lower surface of the base plate; a hook on the lower surface of the base plate; said T-bolt engaging said hook to hold the base plate to the grate support; and said finger being engaged and restrained between the T-bolt and the base plate.

* * * * *